US006768272B2

(12) United States Patent
Shwang-shi

(10) Patent No.: US 6,768,272 B2
(45) Date of Patent: Jul. 27, 2004

(54) APPARATUS FOR DRIVING A FLUORESCENT LAMP

(75) Inventor: Bai Shwang-shi, Taipei (TW)

(73) Assignee: Chi Mei Optoelectonics Corp. (TW)

( * ) Notice: Subject to any disclaimer, the term of this patent is extended or adjusted under 35 U.S.C. 154(b) by 50 days.

(21) Appl. No.: 10/180,103

(22) Filed: Jun. 27, 2002

(65) Prior Publication Data

US 2003/0015971 A1 Jan. 23, 2003

(30) Foreign Application Priority Data

Jul. 11, 2001 (TW) ..... 90117015 A

(51) Int. Cl.[7] ..... H05B 37/02

(52) U.S. Cl. ..... 315/224; 315/209 PZ; 315/307; 310/318

(58) Field of Search ..... 315/224, 209 R, 315/209 PZ, 307, DIG. 4; 310/316, 318

(56) References Cited

U.S. PATENT DOCUMENTS 5,739,622 A * 4/1998 Zaitsu ..... 310/316.01
6,239,558 B1 * 5/2001 Fujimura et al. ..... 315/307
6,268,681 B1 * 7/2001 Yamaguchi et al. ... 310/316.01
6,348,755 B1 * 2/2002 Shimamura et al. ..... 310/318
6,531,835 B2 * 3/2003 Chen et al. ..... 315/307

* cited by examiner

*Primary Examiner*—Don Wong
*Assistant Examiner*—Ephrem Alemu
(74) *Attorney, Agent, or Firm*—Rabin & Berdo, P.C.

(57) ABSTRACT

An apparatus for driving a fluorescent lamp. The apparatus includes a dynamic driving voltage generator and an inverter. The dynamic driving voltage generator outputs a dynamic driving voltage. The inverter is coupled to the dynamic driving voltage generator and the fluorescent lamp for outputting a lamp-driving voltage according to the dynamic driving voltage. Wherein, the lamp-driving voltage is used to drive the fluorescent lamp, the lamp-driving voltage is fed back to the dynamic driving voltage generator, and the dynamic driving voltage generator outputs the dynamic driving voltage according to the lamp-driving voltage.

16 Claims, 6 Drawing Sheets

APPARATUS FOR DRIVING A FLUORESCENT LAMP

This application incorporates by reference of Taiwan application Serial No. 90117015, filed Jul. 11, 2001.

BACKGROUND OF THE INVENTION

1. Field of the Invention

The invention relates in general to an apparatus for driving a fluorescent lamp, and more particularly to an apparatus for driving a fluorescent lamp by dynamically adjusting the driving voltage.

2. Description of the Related Art

With the improvement and innovation of science and technology, the development of display technology changes rapidly and makes progress at a tremendous pace. The traditional CRT (Cathode Ray Tube) display has gradually dropped out of the display market due to its large volume and serious radiation and is gradually replaced by LCD (Liquid Crystal Display) monitors. An LCD monitor includes fluorescent lamps for backlighting. Cold-cathode fluorescent lamps (CCFL) are commonly used as back-light due to the durability and high efficiency.

A sufficiently high startup AC voltage is required to start up a cold-cathode fluorescent lamp, and then an operation voltage which is much lower than the startup voltage is needed to make the lamp be lighted. For example, the startup AC voltage for a 15" LCD monitor is 1200V, and the operation voltage is only 600V. In practice, the voltage source of the LCD monitor is usually a DC voltage of 12V, and the startup voltage and the operation voltage are generated thereby.

FIG. 1 is a block diagram showing a traditional apparatus for driving a fluorescent lamp. A DC-AC inverter is needed to transform the DC 12V into AC 1200V because the startup voltage needed by the fluorescent lamp to start up is 1200V, and the power voltage is only DC 12V. A Royer type inverter is commonly used. An AC 1200V is generated by the inverter 120 according to the DC voltage source of 12V. It is well known that the instance that, as the capacitor C1 is charged by a voltage source, the impedance of the capacitor C1 changes. According to this transient state, the voltage of AC 1200V generated by the inverter 120 is applied to the fluorescent lamp 130 at start up. Then the capacitor C1 reaches a stable state and the voltage across the fluorescent lamp 130 is designed to decreased to 600V, which is the operating or operation voltage.

FIG. 2 is a diagram of time vs. the voltage of the fluorescent lamp. At first, a startup voltage of 1200V is applied to the fluorescent lamp 130 because the impedance of the capacitor C1 is zero at the transient state. Then, an operation voltage of 600V is applied because the capacitor C1 reaches the stable state.

However, the driving voltage outputted by the inverter 120 is 1200V regardless of the voltage demand of the fluorescent lamp. While the operation voltage is only 600V, the inverter still outputs 1200V. There are some disadvantages. For example, the power efficiency is bad, heat is generated more, and bodily harm may be caused. In addition, the power consumption for a notebook is more critical. The traditional apparatus for driving the fluorescent lamp causes much power waste and needs to be further improved.

Moreover, the fluorescent lamp degrades with time, and needs a higher startup voltage. For example, a new fluorescent lamp needs a startup voltage of 1200V, and but after a few years it may need the a startup voltage of 1800V. The traditional approach to solve this problem is to set the startup voltage to a voltage higher than needed, such as 1800V, to ensure that a few years later the fluorescent lamp is still workable. This approach causes much more power waste.

The disadvantages of the traditional apparatus for driving the fluorescent lamp are as follows:

1. Bodily harm may be caused because the output voltage of the inverter remains at a very high level.
2. Power is wasted due to the high output voltage of the inverter.
3. The insulation material should be good enough, which costs more.

SUMMARY OF THE INVENTION

It is therefore an object of the invention to provide an improved apparatus for driving the fluorescent lamp by dynamically changing the driving voltage to save power and reduce the insulation requirement.

The invention achieves the above-identified objects by providing a new apparatus for driving a fluorescent lamp. The apparatus includes a dynamic driving voltage generator and an inverter. The dynamic driving voltage generator is coupled to a DC voltage source for outputting a dynamic driving voltage. The inverter is coupled to the dynamic driving voltage generator and the fluorescent lamp for outputting a lamp-driving voltage according to the dynamic driving voltage. Wherein, the lamp-driving voltage is used to drive the fluorescent lamp, the lamp-driving voltage is fed back to the dynamic driving voltage generator, and the dynamic driving voltage generator outputs the driving voltage according to the lamp-driving voltage.

Other objects, features, and advantages of the invention will become apparent from the following detailed description of the preferred but non-limiting embodiments. The following description is made with reference to the accompanying drawings.

DETAILED DESCRIPTION OF THE INVENTION

Figure 3:
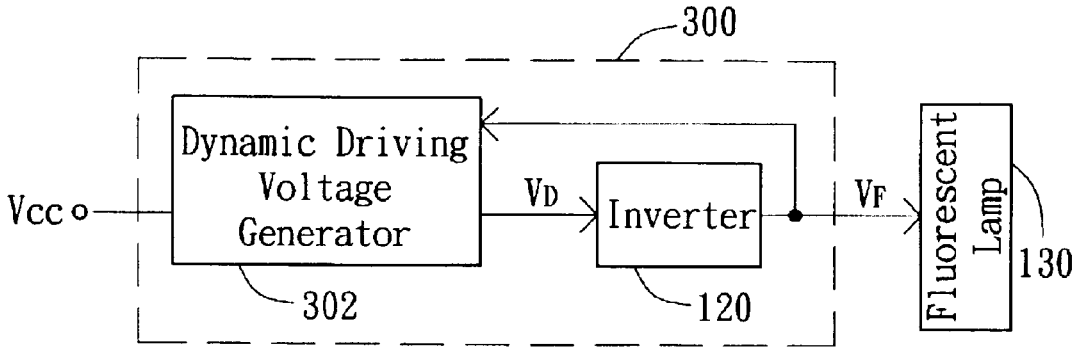
FIG. 3 is a block diagram showing the apparatus for driving the fluorescent lamp according to this invention.

FIG. 3 is a block diagram showing the apparatus for driving the fluorescent lamp. The invention dynamically changes the voltage outputted to the fluorescent lamp 130 according to the need of the fluorescent lamp 130. The driving apparatus 300 is capable of detecting whether the fluorescent lamp 130 starts up and accordingly outputs the startup voltage $V_{FS}$ or the operation voltage $V_{FO}$. The fluorescent lamp 130 is at a startup phase when the lamp 130 is started and then at a stable phase afterwards. The driving apparatus 300 includes a dynamic driving voltage generator 302 and an inverter 120. The dynamic driving voltage generator 302 is coupled to a DC voltage source $V_{CC}$ for generating a dynamic driving voltage $V_D$. The inverter 120 is coupled to the dynamic driving voltage generator 302 and the fluorescent lamp 130. The inverter 120 generates a lamp-driving voltage $V_F$ according to the dynamic driving voltage $V_D$. The lamp-driving voltage $V_F$ is used to drive the fluorescent lamp 130, and the lamp-driving voltage $V_F$ is fed back to the dynamic driving voltage generator 302, and the dynamic driving voltage generator 302 outputs the dynamic driving voltage $V_D$ according to the lamp-driving voltage $V_F$. The embodiments according to this invention are described in detail in the following paragraphs.

Embodiment 1

Figure 1:
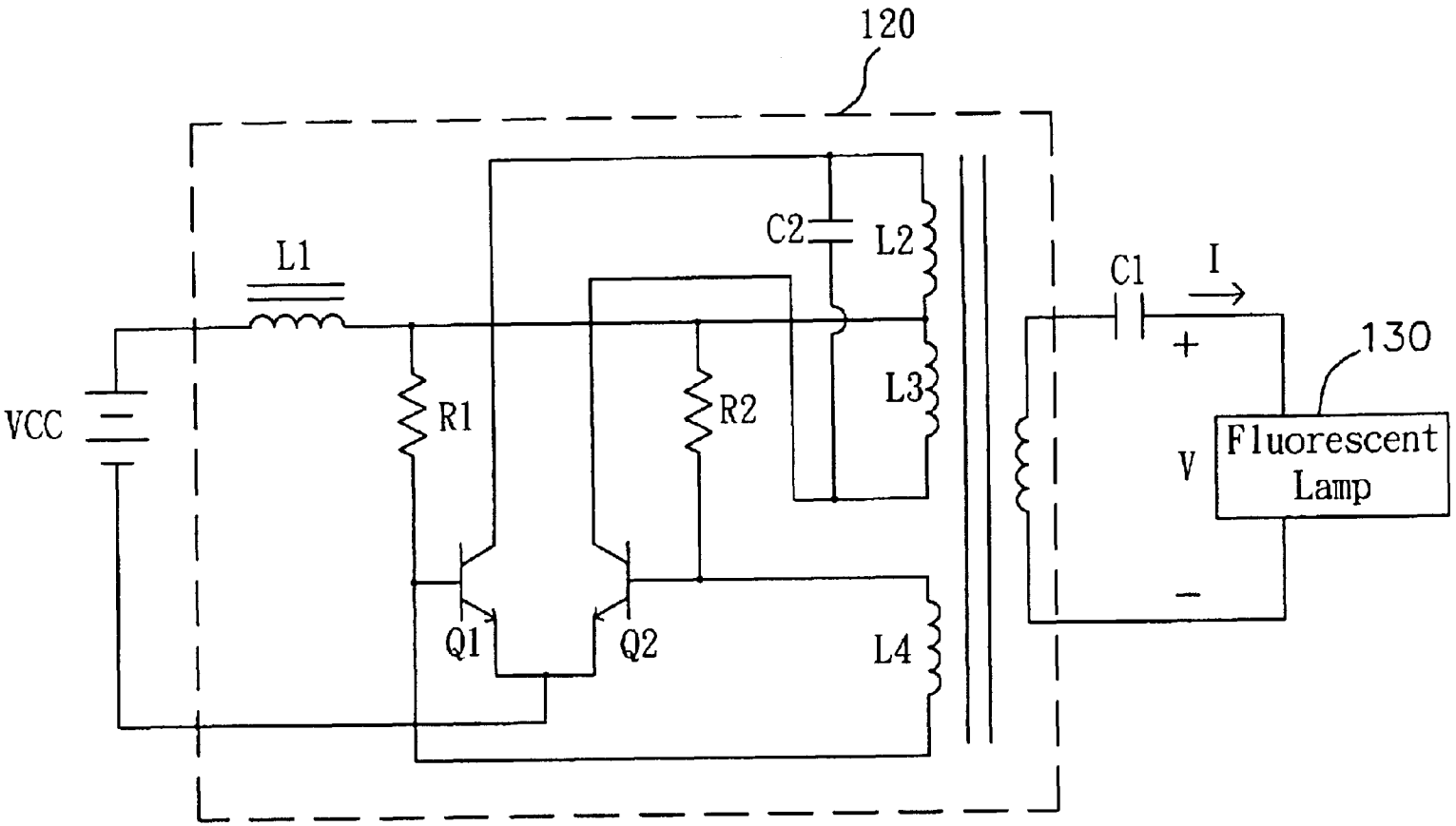
FIG. 1 (PRIOR ART)
FIG. 1 is a block diagram showing a traditional apparatus for driving a fluorescent lamp.
Figure 2:
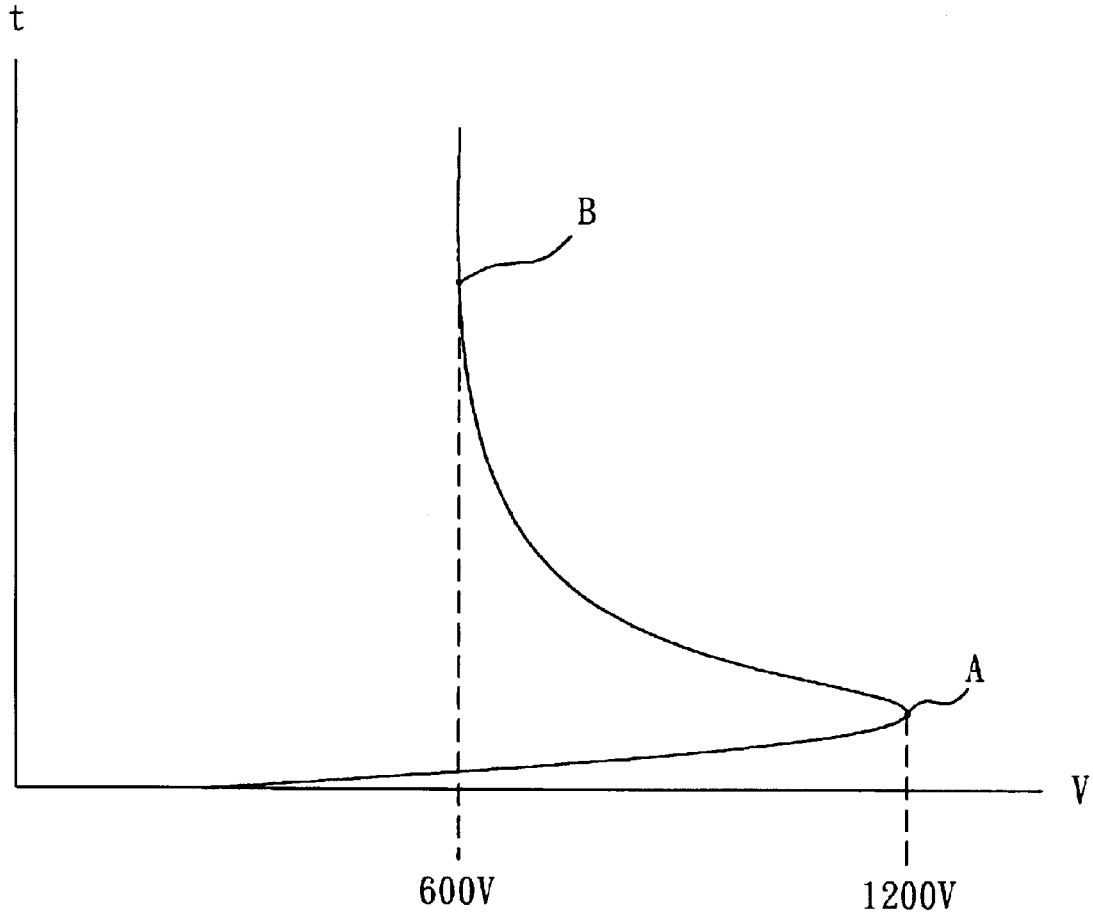
FIG. 2 (PRIOR ART)
FIG. 2 is a diagram showing time vs. the voltage of the fluorescent lamp.
Figure 4A:
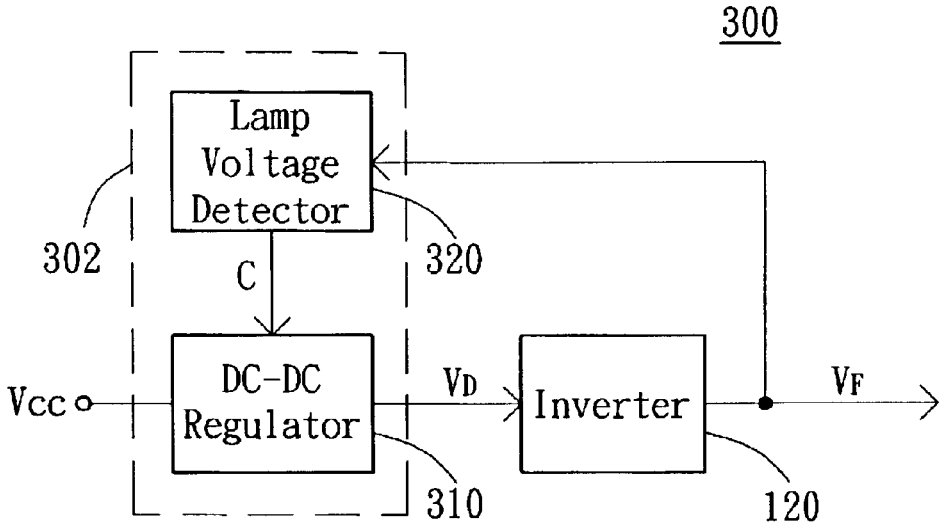
FIG. 4A is a block diagram showing the dynamic driving voltage generator of the first embodiment according to this invention.

FIG. 4A is a block diagram showing the dynamic driving voltage generator 302 of the first embodiment according to this invention. The dynamic driving voltage generator 302 includes a DC-DC regulator 310 and a lamp voltage detector 320. The DC-DC regulator 310 receives the DC voltage source $V_{CC}$ and outputs the DC dynamic driving voltage $V_D$ and is used to reduce the load effect for stabilizing the power supplied by the voltage source $V_{CC}$. A pulse width modulation DC-DC converter (PWM DC-DC converter) is an example of the DC-DC regulator 310. The AC lamp-driving voltage $V_F$ is generated by the inverter 120 according to the dynamic driving voltage $V_D$. At the startup phase, the high-level dynamic driving voltage $V_{DH}$ is generated by the DC-DC regulator 310 and accordingly the lamp-driving voltage $V_F$ is generated by the inverter 120 as the startup voltage $V_{FS}$. The lamp voltage detector 320 is coupled to the fluorescent lamp 130 and the DC-DC regulator 310 for detecting the lamp-driving voltage $V_F$. The lamp voltage detector 320 detects whether the voltage of the fluorescent lamp 130 decreases to determine if the fluorescent lamp 130 has started up, according to the phenomenon shown in FIG. 2. In other words, the lamp voltage detector 320 detects whether $$\frac{dV_F}{dt} < 0;$$

if it is true, the fluorescent lamp has started up and the driving apparatus 300 enters the stable phase. At the stable phase, the low-level dynamic driving voltage $V_{DL}$ is generated by the DC-DC regulator 310 and accordingly the lamp-driving voltage $V_F$ is generated by the inverter 120 as the operation voltage $V_{FO}$.

Figure 4B:
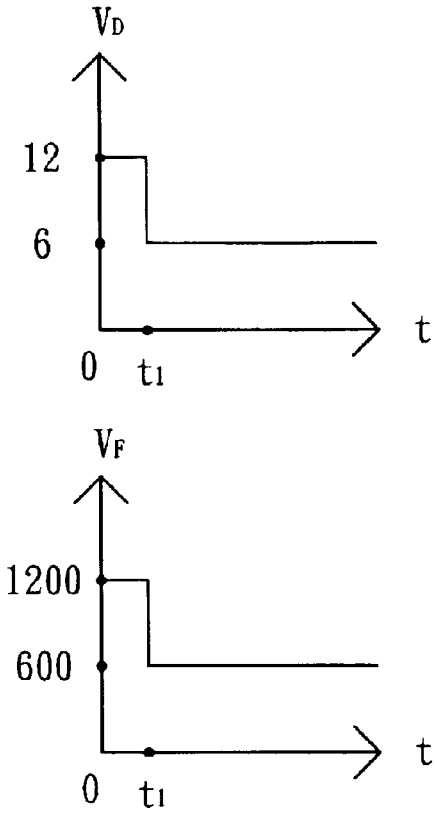
FIG. 4B is a diagram of the dynamic driving voltage and the lamp-driving voltage.

FIG. 4B is a diagram of the dynamic driving voltage $V_D$ and the lamp-driving voltage $V_F$ according to this invention. The dynamic driving voltage generator 302 generates a dynamic driving voltage of 12V at the startup phase when the DC voltage source of 12V is inputted, and accordingly the inverter 120 generates a lamp-driving voltage $V_F$ of 1200V to start up the fluorescent lamp 130. When the dynamic driving voltage generator 302 detects that the fluorescent lamp has started up at time t1, the dynamic driving voltage $V_D$ is decreased to 6V, and accordingly the inverter 120 generates the operation voltage of 600V.

Embodiment 2

Figure 5:
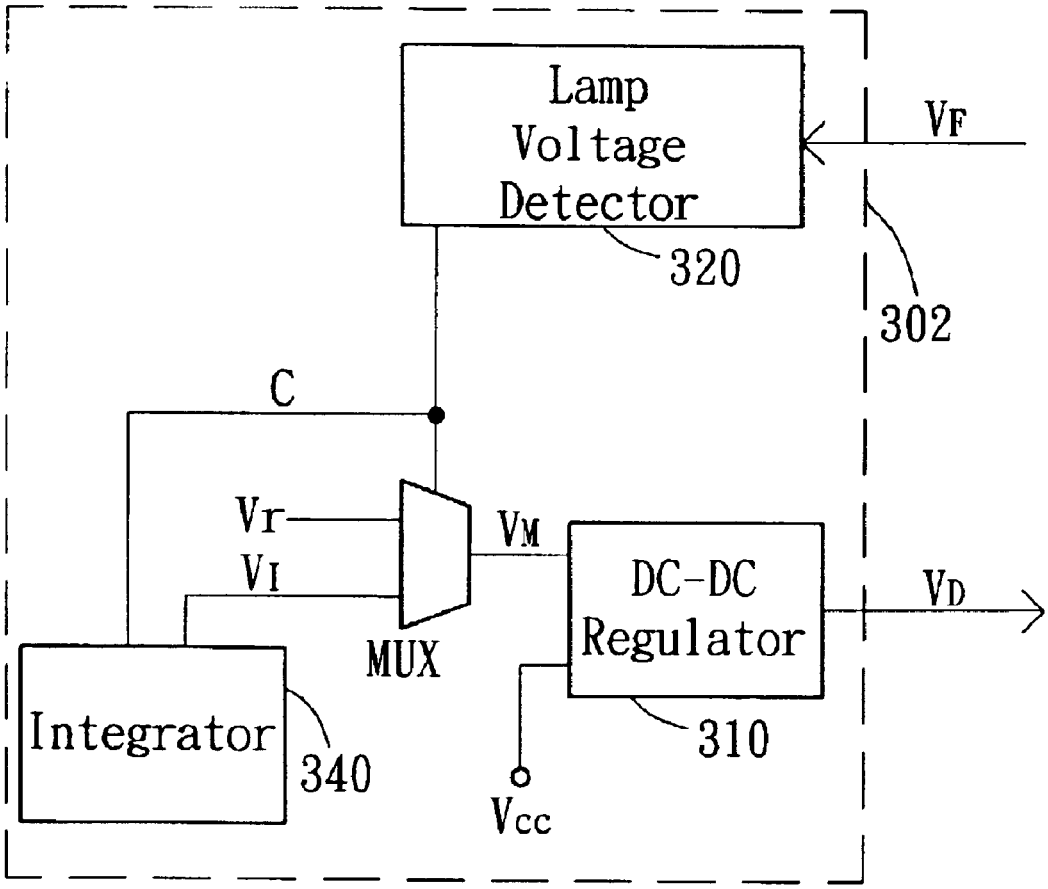
FIG. 5 is another block diagram showing the dynamic driving voltage generator of the second embodiment according to this invention.

FIG. 5 is another block diagram showing the dynamic driving voltage generator 302 of the second embodiment according to this invention. The dynamic driving voltage generator 302 receives the lamp-driving voltage $V_F$ and accordingly generates dynamic driving voltage $V_D$. The dynamic driving voltage generator 302 includes lamp voltage detector 320, a multiplexer MUX, and an integrator 340. The lamp voltage detector 320 is coupled to the fluorescent lamp 130, the multiplexer MUX, and the integrator 340. The lamp voltage detector 320 receives the lamp-driving voltage $V_F$ and accordingly outputs a control signal C. The multiplexer MUX is coupled to the lamp voltage detector 320, the DC-DC regulator 310, and the integrator 340. The multiplexer MUX receives a bias voltage Vr and an integral voltage $V_I$ and selectively outputs one of the bias voltage Vr and the integral voltage $V_I$ as an adjustment voltage $V_M$ according to the control signal C. The integrator 340 is coupled to the multiplexer MUX, and the lamp voltage detector 320 for outputting the integral voltage $V_I$, wherein the integral voltage $V_I$ increases with time. At the startup phase, the multiplexer MUX selects the integral voltage $V_I$ as the adjustment voltage $V_M$. Then the DC-DC regulator 310 outputs the dynamic driving voltage $V_D$ according to the adjustment voltage $V_M$. Wherein, the dynamic driving voltage $V_D$ also increases with time. Then, the inverter 120 generates the lamp-driving voltage $V_F$ according to the dynamic driving voltage $V_D$. Wherein, the lamp-driving voltage $V_F$ also increases with time. The fluorescent lamp 130 starts up when the lamp-driving voltage $V_F$ is larger than the startup voltage $V_{FS}$. When the lamp voltage detector 320 detects that the fluorescent lamp 130 has started up, the lamp voltage detector 320 outputs the control signal C to make the multiplexer MUX select the bias voltage Vr as the adjustment voltage $V_M$, and resets the integrator 340. The bias voltage Vr is a predetermined value to make the DC-DC regulator 310 output the low-level dynamic driving voltage $V_{DL}$, and then the lamp-driving voltage $V_F$ outputted by the inverter 120 is the operation voltage $V_{FO}$. The fluorescent lamp has the problem of degrading with time and that makes the startup voltage uncertain. The solution according to this invention is to use the integrator 340 to output a integral voltage $V_I$ increasing with time to make the lamp-driving voltage $V_F$ also increase with time until the fluorescent lamp 130 starts up.

Figure 6A:
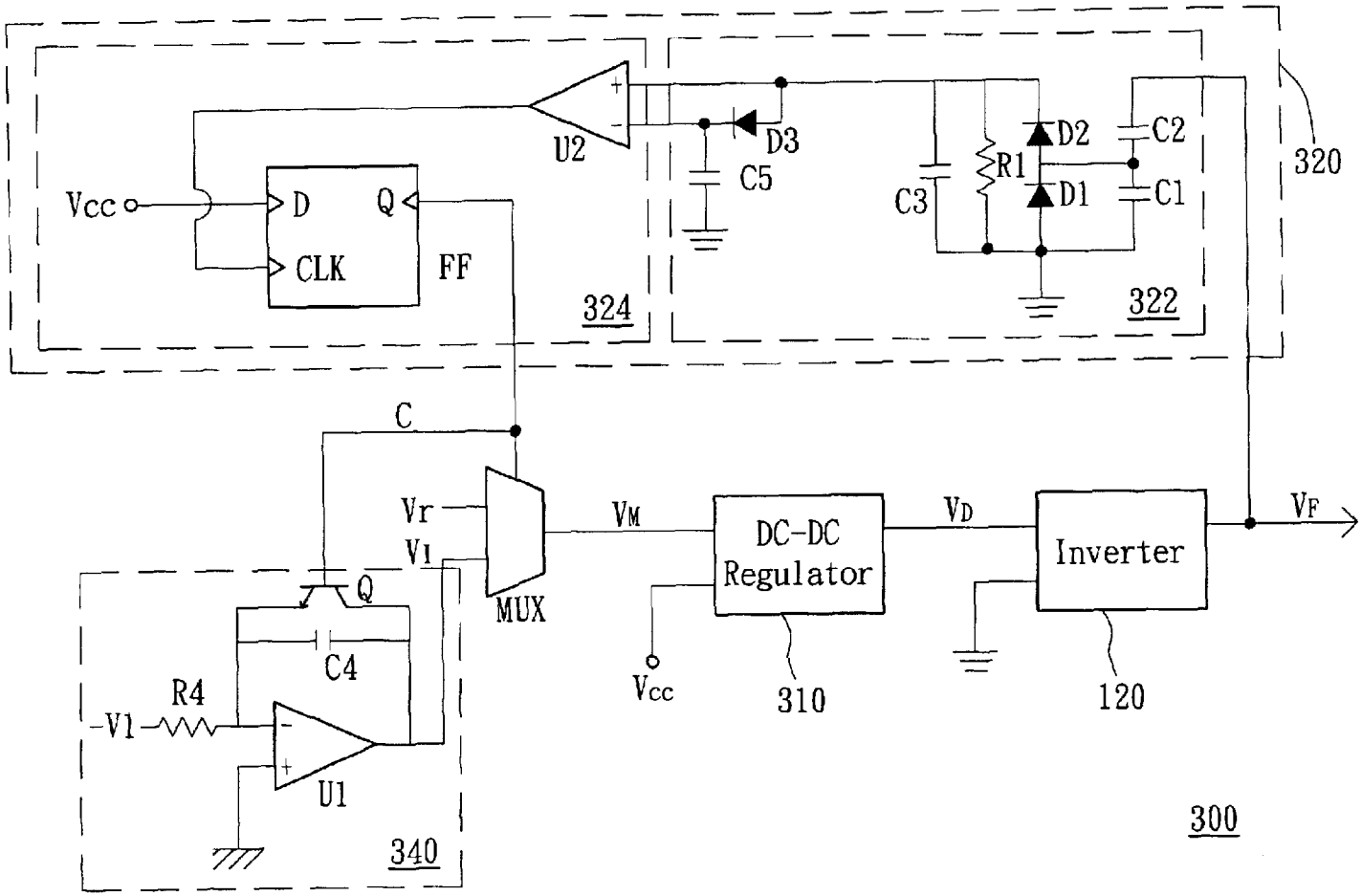
FIG. 6A is a block diagram showing the driving apparatus of the second embodiment according to this invention.

FIG. 6A is a block diagram showing the driving apparatus 300 of the second embodiment according to this invention. The lamp voltage detector 320 includes a peak detector 322 and a comparator 324. The peak detector 322 receives the fed-back lamp-driving voltage $V_F$ and outputs the peak value of the lamp-driving voltage $V_F$ by voltage dividing and rectifying. The comparator 324 checks whether the peak value of the lamp-driving voltage $V_F$ is decreasing. Initially, the flip-flop FF outputs a low-level control signal C. When the peak value begins to decrease, the output of the operation amplifier U2 transits from the low level to the high level, which triggers the control signal C transiting from the low level to the high level. When the control signal C is low, the multiplexer MUX selects the integral voltage $V_I$ to output; when the control signal C is high, the multiplexer MUX selects the bias voltage Vr to output. The integrator 340 outputs the integral voltage $V_I$ increasing with time. Initially, the control signal C is low, and accordingly the transistor Q is not turned on. The integral voltage $V_I$ increases with time by the operation of the operation amplifier U1, capacitor C4 and resistor R4. When the control signal C is turned to high, the transistor Q is turned on, which resets the integrator 340.

Figure 6B:
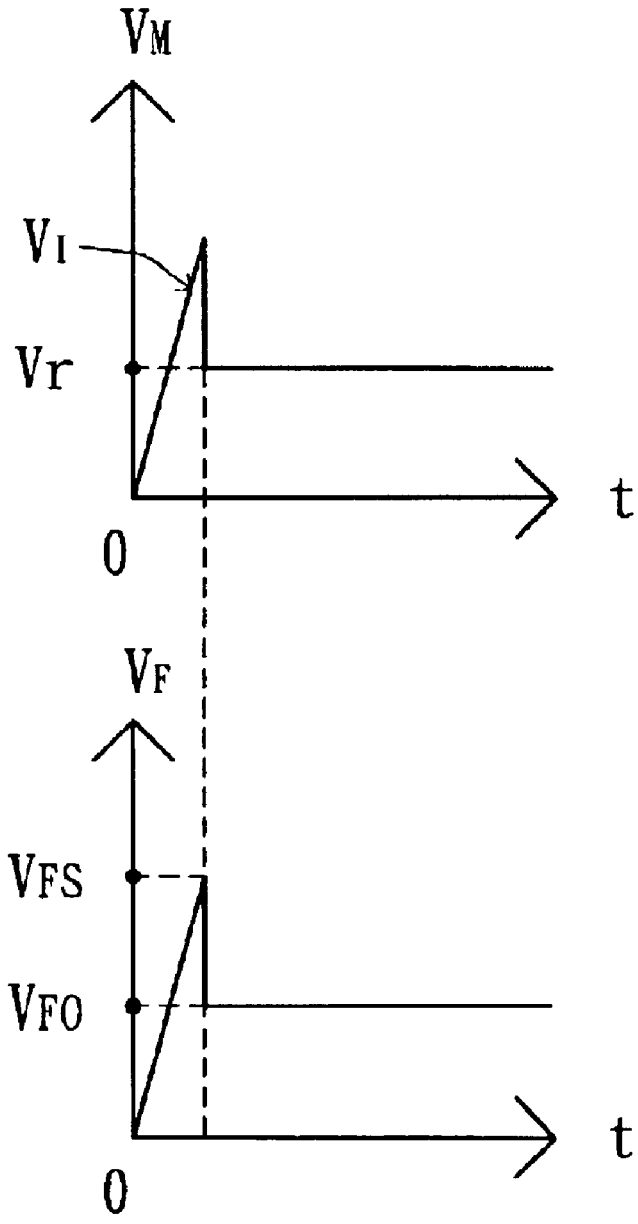
FIG. 6B is a diagram of the adjustment voltage and the lamp-driving voltage.

FIG. 6B is a diagram of the adjustment voltage $V_M$ and the lamp-driving voltage $V_F$. Initially, the adjustment voltage $V_M$ is the integral voltage $V_I$, so the lamp-driving voltage $V_F$ increases with time accordingly. When the fluorescent lamp 130 starts up, the adjustment voltage $V_M$ becomes the bias voltage Vr, and accordingly the lamp-driving voltage $V_F$ becomes the operation voltage $V_{FO}$. The lamp-driving voltage $V_F$ increases with time before the fluorescent lamp starts up, instead of being a constant voltage as the traditional approach. Therefore, the degradation of the fluorescent lamp can be solved because the lamp-driving voltage is dynamically supplied according to the need of the fluorescent lamp. Also, power is saved and bodily harm can be prevented because the operation voltage is much lower than the startup voltage after the fluorescent lamp starts up. And costs are reduced because the insulation requirement of the driving apparatus is not as critical as the traditional approach and the capacitor coupled to the fluorescent lamp in the traditional driving apparatus is no longer needed.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An apparatus for driving a fluorescent lamp comprising:

a dynamic driving voltage generator coupled to a DC voltage source for outputting a dynamic driving voltage; and an inverter coupled to the dynamic driving voltage generator and the fluorescent lamp for outputting a lamp-driving voltage according to the dynamic driving voltage;

wherein the lamp-driving voltage is used to drive the fluorescent lamp, the lamp-driving voltage is fed back to the dynamic driving voltage generator, and the dynamic driving voltage generator outputs the driving voltage according to the lamp-driving voltage, and wherein while the dynamic driving voltage is set at a first value, the lamp-driving voltage output by the inverter is a startup voltage to start up the fluorescent lamp, and while the dynamic driving voltage is set at a second value, the lamp-driving voltage output by the inverter is an operation voltage for continued operation of the fluorescent lamp.

2. The apparatus according to claim 1, wherein the startup voltage is substantially 1200V.

3. The apparatus according to claim 1, wherein the operation voltage is 600V.

4. The apparatus according to claim 1, wherein the inverter is a Royer type inverter.

5. The apparatus according to claim 1, wherein the DC voltage source is 12V.

6. The apparatus according to claim 1, wherein the dynamic driving voltage generator comprises:

a lamp voltage detector for detecting a voltage of the fluorescent lamp and accordingly outputting a control signal; and a DC-DC regulator coupled to the DC voltage source, the inverter, and the lamp voltage detector for outputting the dynamic driving voltage according to the control signal.

7. The apparatus according to claim 6, wherein the control signal is of a first level and accordingly the DC-DC regulator is outputting the dynamic driving voltage of the first value when the voltage of the fluorescent lamp is increasing, and wherein the control signal is of a second level and accordingly the DC-DC regulator is outputting the dynamic driving voltage of the second value when the voltage of the fluorescent lamp is decreasing.

8. The apparatus according to claim 6, wherein the DC-DC regulator is a pulse width modulation DC-DC converter (PWM DC-DC converter).

9. The apparatus according to claim 6, wherein the lamp voltage detector comprises:

a peak detector coupled to the fluorescent lamp for detecting a peak value of the voltage of the fluorescent lamp and then outputs the peak value; and a comparator coupled to the peak detector and the DC-DC regulator for receiving the peak value of the voltage of the fluorescent lamp and accordingly outputting the control signal;

wherein the control signal is of a first level when the peak value is increasing with time, and the control signal is of a second level when the peak value is decreasing with time.

10. The apparatus according to claim 1, wherein the dynamic driving voltage generator comprises:

a DC-DC regulator coupled to the DC voltage source and the inverter for outputting the dynamic driving voltage according to an adjustment voltage;

a lamp voltage detector for detecting a voltage of the fluorescent lamp and outputting a control signal accordingly;

a integrator outputting an integral voltage, wherein the integral voltage increases with time; and a multiplexer coupled to the DC-DC regulator, the lamp voltage detector, and the integral for receiving the control signal, the integral voltage, and a bias voltage, and outputting an adjustment voltage selected from the integral voltage and the bias voltage;

wherein the control signal is of the first level if the fluorescent lamp has not started up, and the control signal is of the second level if the fluorescent lamp has started up.

11. The apparatus according to claim 10 wherein the DC-DC regulator is a pulse width modulation DC-DC converter (PWM DC-DC converter).

12. The apparatus according to claim 10, wherein the lamp voltage detector comprises:

a peak detector coupled to the fluorescent lamp for detecting a peak value of a voltage of the fluorescent lamp and outputting the peak value; and a comparator coupled to the peak detector and the DC-DC regulator for receiving the peak value and accordingly outputting the control signal;

wherein the control signal is of the first level when the peak value increases with time, and the control signal is of the second value when the peak value decreases with time.

13. The apparatus according to claim 10, wherein the multiplexer selects the integral voltage to output when the control signal is of the first level, in order to make the dynamic driving voltage increase with time according to the integral voltage, and accordingly make the lamp-driving voltage increase with time until the fluorescent lamp starts up.

14. The apparatus according to claim 10, wherein the integrator is coupled to the lamp voltage detector for receiving the control signal, the integrator outputs the integral voltage when the control signal is of the first level, and the integrator is reset when the control signal is of the second level.

15. The apparatus according to claim 10, wherein the multiplexer selects the bias voltage to output when the control signal is of the second level, in order to make the lamp-driving voltage be an operation voltage.

16. The apparatus according to claim 15, wherein the operation voltage is 600V.

* * * * *